US009708117B1

(12) United States Patent
Keuleers et al.

(10) Patent No.: US 9,708,117 B1
(45) Date of Patent: Jul. 18, 2017

(54) PACKAGED PRODUCT

(71) Applicant: The Procter & Gamble Company, Cincinnati, OH (US)

(72) Inventors: Robby Renilde Francois Keuleers, Lippelo (BE); Katrien De Malsche, Hamme (BE); Raf Gustaaf Alfons Degeyter, Herk-De-Stad (BE); Katy Saint-Ignan, Ixelles (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/428,233

(22) Filed: Feb. 9, 2017

(30) Foreign Application Priority Data

Feb. 11, 2016 (EP) ..... 16155328

(51) Int. Cl.

| | |
|---|---|
| ***B65D 85/62*** | (2006.01) |
| ***B65D 75/30*** | (2006.01) |
| ***B65D 50/00*** | (2006.01) |
| ***B65D 65/46*** | (2006.01) |
| ***B65D 83/04*** | (2006.01) |
| ***B65D 25/04*** | (2006.01) |
| ***D06F 39/02*** | (2006.01) |

(52) U.S. Cl.
CPC ..... *B65D 85/62* (2013.01); *B65D 25/04* (2013.01); *B65D 50/00* (2013.01); *B65D 65/46* (2013.01); *B65D 75/30* (2013.01); *B65D 83/0409* (2013.01); *D06F 39/026* (2013.01)

(58) Field of Classification Search
CPC ..... B65D 85/62; B65D 75/30; B65D 50/00; B65D 65/46; B65D 83/0409; B65D 25/04; D06F 39/026
See application file for complete search history.

(56) References Cited

U.S. PATENT DOCUMENTS

| | | | |
|---|---|---|---|
| 2,960,259 | A | 11/1960 | Aveni |
| 3,300,090 | A | 1/1967 | Carden |
| 3,578,207 | A | 5/1971 | Danow |
| 3,591,043 | A | 7/1971 | Murphy |
| 3,877,473 | A | 4/1975 | Williams |
| 5,779,095 | A | 7/1998 | Diamond |
| 9,523,066 | B2 | 12/2016 | Krubasik et al. |

(Continued)

FOREIGN PATENT DOCUMENTS

| | | |
|---|---|---|
| EP | 2 924 162 | 9/2015 |
| WO | WO 00/55068 A1 | 9/2000 |
| WO | WO 2012/025315 A1 | 3/2012 |

OTHER PUBLICATIONS

EP Search Report for Application No. 16155328.4-1708, dated Oct. 13, 2016, 12 pages.

(Continued)

*Primary Examiner* — Michael C Miggins
(74) *Attorney, Agent, or Firm* — Melissa Krasovec; Leonard W. Lewis; Steven W Miller

(57) ABSTRACT

A packaged product including a container wherein the container includes an opening and an internal compartment, and at least two flexible water-soluble unit dose articles held within the internal compartment of the container, wherein the unit dose articles are positioned side-by-side to form a single row of unit dose articles within the container, and wherein the ratio of the largest cross-sectional dimension of the unit dose article to the smallest cross-sectional dimension of the internal compartment is from 1.2:1 to 1:1.8 and a process of its use.

23 Claims, 11 Drawing Sheets

(56) References Cited

U.S. PATENT DOCUMENTS

| | | | |
|---|---|---|---|
| 2002/0033004 | A1 | 3/2002 | Edwards et al. |
| 2005/0139241 | A1 | 6/2005 | Jowett et al. |
| 2005/0279755 | A1 | 12/2005 | Jansen |
| 2006/0249534 | A1 | 11/2006 | Sainz |
| 2008/0014392 | A1 | 1/2008 | Ayats et al. |
| 2012/0070106 | A1 | 3/2012 | Camargo-Parodi et al. |
| 2013/0292414 | A1 | 11/2013 | Sutherland |
| 2015/0210969 | A1 | 7/2015 | Brandt-Sanz et al. |
| 2015/0275152 | A1 | 10/2015 | Brooker et al. |
| 2015/0275153 | A1 | 10/2015 | Murphy |

OTHER PUBLICATIONS

U.S. Appl. No. 15/428,249, filed Feb. 9, 2017, Robby Renilde Francois Keuleers.
U.S. Appl. No. 15/428,256, filed Feb. 9, 2017, Robby Renilde Francois Keuleers.
U.S. Appl. No. 15/428,264, filed Feb. 9, 2017, Robby Renilde Francois Keuleers.
U.S. Appl. No. 15/428,271, filed Feb. 9, 2017, Robby Renilde Francois Keuleers.

PACKAGED PRODUCT

FIELD OF THE INVENTION

The present invention relates to packaged products, particularly comprising a container and water-soluble unit dose articles

BACKGROUND OF THE INVENTION

Water-soluble unit dose articles comprising cleaning compositions have become very popular with consumers. Such articles contain the cleaning composition which is only released once the article is contacted with water. This offers a convenient means for the consumer to dose the cleaning composition into the wash liquor without the need for scoops or other measuring means. Such unit dose articles are often packaged in tubs or bags, in which multiple unit dose articles are arranged randomly within the package.

However, an issue with such articles is that because they are water-soluble, they can rupture prematurely when they accidentally come into contact with water during storage. Such contact could include consumers accidentally touching an article with wet hands when retrieving a neighbouring article in a packaging tub or bag, or due to contact with moisture in the air during storage. Rupturing of articles can be messy and inconvenient for the consumer and can cause contamination of neighbouring articles.

Related to this is the tendency for neighbouring pouches to stick to one another. This results in further requirements for the consumer to handle the neighbouring pouches in order to separate them before use. This in turn results in further opportunities for the neighbouring pouch to come into contact with moisture ahead of use.

Furthermore, moisture transfer can result in articles 'clumping' together meaning that said 'clumps' can get stuck in the opening of the package interfering with the wash process and/or the consumer has to touch the articles (including neighbouring articles) further in order to break the clumps apart.

Additionally, it is preferred to provide a system in which the instances of the consumer touching the article are reduced in order to minimise chemistry transfer from the surface of the article to the human hand.

Therefore, there is a need in the art for packaged product that at least in part overcomes the above-mentioned problems. However, such packaged products should be preferably be efficient, reliable and repeatable to use in a convenient manner. The time taken to complete the dosing operation should not be significantly longer than using executions currently on the market as this negatively affects the wash operation for the consumer as it reduces efficiency and convenience.

It was surprisingly found that a packaged product according to the present invention addressed the above-mentioned problems.

SUMMARY OF THE INVENTION

The present invention relates A packaged product comprising a container wherein the container comprises an opening and an internal compartment, and at least two flexible water-soluble unit dose articles held within the internal compartment of the container, wherein the unit dose articles are positioned side-by-side to form a single row of unit dose articles within the container, wherein the unit dose article comprises at least a first film and second film wherein the first film and second film are sealed together forming a seal area wherein said seal area runs around the periphery of the pouch defining a first two dimensional cross-sectional plane; and wherein the pouch comprises a first smallest cross-sectional axis and a first largest cross sectional axis wherein the first smallest and first largest cross-sectional axis cross one another through a geometrical centre point of the first two dimensional cross-sectional plane; and wherein the internal compartment of the container comprises a second two-dimensional cross-sectional plane parallel to the first two-dimensional cross-sectional plane; and wherein the internal compartment comprises a second smallest cross-sectional axis and a second largest cross sectional axis wherein the second smallest and second largest cross-sectional axis cross one another through a geometrical centre point of the second two dimensional cross-sectional plane;

and wherein the ratio of the first largest cross-sectional dimension to the second largest cross-sectional dimension is from 1.2:1 to 1:1.8 and the first smallest cross-sectional dimension to the second smallest cross-sectional dimension of the internal compartment is from 1.2:1 to 1:1.8.

The present invention also relates to a method of using the packaged product according to the present invention.

DETAILED DESCRIPTION OF THE INVENTION

Packaged Product

Figure 1:
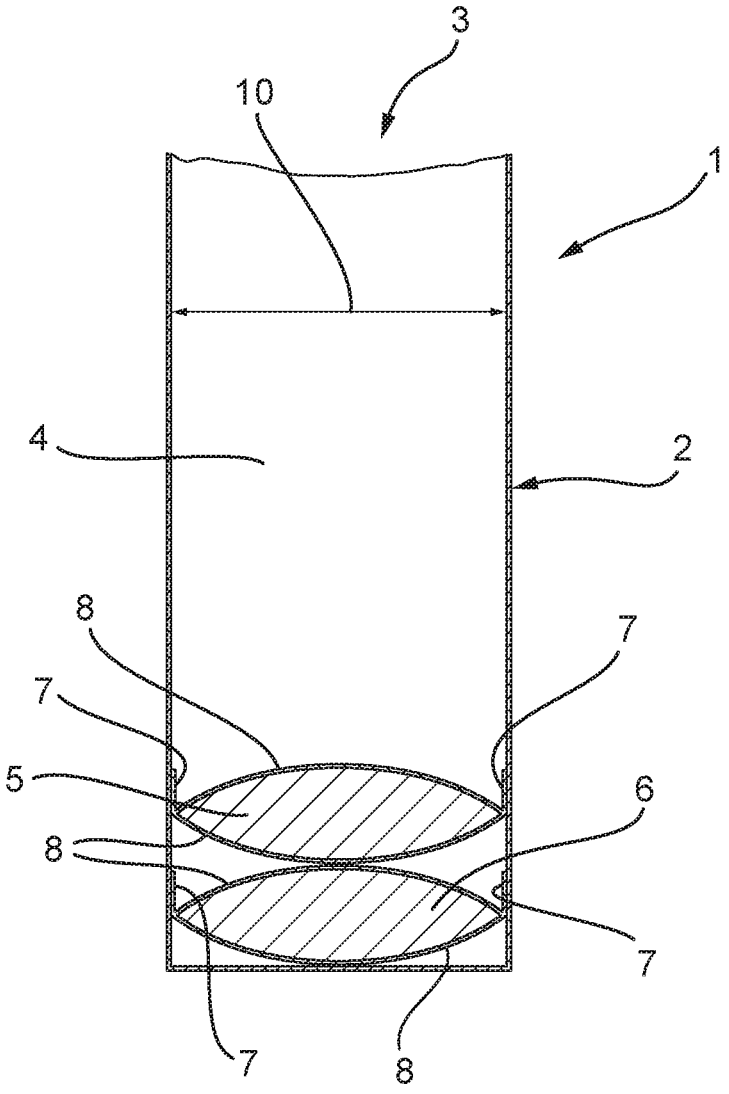
FIG. 1 discloses a packaged product according to the present invention

The present invention is to a packaged product comprising a container wherein the container comprises an opening and an internal compartment.

At least two flexible water-soluble unit dose articles are held within the internal compartment of the container. The unit dose article comprises at least a first film and second film wherein the first film and second film are sealed together forming a seal area wherein said seal area runs around the periphery of the pouch defining a first two dimensional cross-sectional plane. The unit dose article comprises a first smallest cross-sectional axis and a first largest cross sectional axis wherein the first smallest and first largest cross-sectional axis cross one another through a geometrical centre point of the first two dimensional cross-sectional plane.

The unit dose articles are positioned side-by-side to form a single row of unit dose articles within the container. This row could be horizontal, vertical or any other direction, preferably vertical.

The internal compartment comprises a second smallest cross-sectional axis and a second largest cross sectional axis wherein the second smallest and second largest cross-sectional axis cross one another through a geometrical centre point of the second two dimensional cross-sectional plane.

The ratio of the first largest cross-sectional dimension to the second largest cross-sectional dimension is from 1.2:1 to 1:1.8 and the first smallest cross-sectional dimension to the second smallest cross-sectional dimension of the internal compartment is from 1.2:1 to 1:1.8.

Without wishing to be bound by theory, the unit dose articles are removed from the internal compartment via the opening. The consumer may retrieve the unit dose article by placing their hand or fingers through the opening and picks out a unit dose article. Alternatively, the consumer may tilt or position the container such that the unit dose article exits the opening via gravity. Alternatively, the consumer may actuate a mechanical means to force a unit dose article to exit the opening from the internal compartment.

The container and the unit dose articles are described in more detail below.

The packaged product can be sold 'as is', in other words the container is the item that the consumer picks up from the shelf. Alternatively, the packaged product could be housed as one unit of a multi-component consumer product. For example, more than one packaged product could be housed within an outer package and the multiple packaged products sold together in a single purchase.

The packaged product may be a component in a larger apparatus. For example, the packaged product may be a 'refill' for use in a dispensing device. Those skilled in the art would recognise suitable dispensing devices. Suitable dispensing devices may comprise means to effect the release of a single unit dose article from the device upon actuation of the device by a consumer. Such means could include, moving blocking means, gripping means or a combination thereof.

The packaged product may comprise aesthetic elements, for example shrink sleeves or labels attached to the container. Alternatively, the container may be coloured or printed with aesthetic elements or informative print such as instructions.

Container

The container comprises an opening and an internal compartment.

The container may be of any suitable shape. The container may have an overall straight shape, e.g. with straight sides, or may have a curved shape or may comprise both straight and curved elements. The container may have a cubic shape, a cylindrical shape, a rectangular or triangular shape. Preferably the container has a straight shape, i.e. a shape comprising straight sides.

The container may be made from any suitable material. The container may be made from metallic materials, Aluminium, plastic materials, cardboard materials, laminates, cellulose pulp materials or a mixture thereof. The container may be made from a plastic material, preferably a polyolefin material. The container may be made from polypropylene, polystyrene, polyethylene, polyethylene terephthalate, PVC or a mixture thereof or more durable engineering plastics like Acrylonitrile Butadiene Styrene (ABS), Polycarbonates, Polyamides and the like The material used to make the container may comprise other ingredients, such as colorants, preservatives, plasticisers, UV stabilizers, Oxygen, perfume and moisture barriers recycled materials and the like.

The container may be made used any suitable process Suitable processes include but are not limited to thermoforming, injection molding, injection stretch blow molding, extrusion blowmolding, tube forming from a flat laminate with a welding step, extruded tube forming.

The container may be opaque, transparent or translucent. Preferably, the container is opaque. The container may comprise a region, such as a strip that allows the consumer to view the internal compartment of the container and ascertain how many unit dose article are present.

Preferably the container has a recognisable base such that when at rest the base is located on the underside of the container as it rests on a surface. By virtue, the container will also have a top and sides.

The container comprises an internal compartment. The container comprises walls having an inner surface and an outer surface. The outer surface of the walls comprise the external side of the packaged article. The inner walls define the internal compartment. The container may comprise more than one internal compartment.

The internal compartment may have any suitable shape. The shape of the internal compartment may be substantially the same shape as the container or may differ from the shape of the container. The internal compartment may have any suitable shape. Those skilled in the art will recognise suitable shapes able to accommodate the unit dose articles. The internal compartment may be circular, square, rectangular, triangular or oval in shape.

The container comprises an opening. The opening is located between the internal compartment and the external environment of the container and allows the unit dose articles located within the internal compartment to exit the container when desired by the consumer. The opening may be located at any suitable point on the container, but needs to be of sufficient size to allow a water-soluble unit dose article to pass through it. The opening may be arranged so that the unit dose article exits the container vertically or horizontally or diagonally (i.e any angle between horizontal and vertical), preferably vertically, when the consumer is holding the container. The container is also arranged such that it can be held by the consumer to allow said horizontal or vertical exit of the water-soluble unit dose article.

The opening may be located at the top of the container. The opening may be located at the base of the container. The opening may be located on the side of the container. The opening may be located on the side of the container, but be more substantially located towards the base of the container. Without wishing to be bound by theory, it may be preferable that the opening is located at the base of the container or on the side of the base but more substantially towards the base than the top, as gravity would aid in the transfer of the water-soluble unit dose article from the internal compartment, through the opening and into the environment external of the packaged product.

The opening may comprise a recloseable means. The recloseable means partially or completely covers the opening when in a closed position such that a water-soluble unit dose article cannot pass through the opening. Preferably, when in a closed position the recloseable means completely covers the opening. When in an open position, the recloseable means allows a water-soluble unit dose article to pass through the opening.

The recloseable means may be in the form of a lid which can be removed and replaced by the consumer. The recloseable means may be in the form of a lid that remains attached to the container using a suitable means, for example a hinge mechanism. The recloseable means may be opened via manual or mechanical means or a mixture thereof. Those skilled in the art would recognise suitable mechanical means. Suitable mechanical means include but are not limited to push, turn, spring mechanisms and mixtures thereof. The mechanical means may comprise an electronic element, such as an electronically controlled actuation means. Those skilled in the art would recognise suitable electronic means.

The opening means may be closed via a mechanical or electronic means. This has the benefit of increasing the probability of the consumer closing the container following use to minimise water ingress.

The recloseable means may be a child deterrent closure. Herein we mean a closure designed such that children find difficulty in opening the recloseable means but such means can easily be operated by adults. Those skilled in the art would recognise such suitable child deterrent closures.

The container may comprise a second opening. Such second opening may be used for example to refill the container with unit dose articles by the consumer.

The container comprises at least two flexible water-soluble unit dose articles. By 'flexible' we herein mean that the water-soluble unit dose articles are not rigid, rather they are formed in a manner that allows the shape to deform upon application of a suitable external force, but return to substantially their original shape upon removing said external force. This deformation characteristic allows the unit dose article to 'squash' allowing it to fit into a space that is smaller than a particular dimension of the unit dose article when the unit dose article is at rest. For example, the side walls of the container may be placed at a distance smaller than the width of the unit dose article. However, when the unit dose article is placed between them, the width of the unit dose article decreases due to the pressure exerted by the side walls, but the height of the unit dose article may correspondingly increase to accommodate the reduced internal volume of the unit dose article caused by the reduced width.

The unit dose article comprises at least a first film and second film wherein the first film and second film are sealed together forming a seal area wherein said seal area runs around the periphery of the pouch defining a first two dimensional cross-sectional plane.

By 'periphery' we herein mean the outer perimeter of the unit dose article as a whole. It does not mean for example the outer perimeter an individual compartment of the unit dose article wherein the unit dose article has more than one compartment.

The unit dose article may comprise a flange. Said flange is comprised of excess sealed film material that protrudes beyond the edge of the unit dose article and provides increased surface area for seal of the first and second films. It is located at the seal area. Since the flange is also made of the same flexible film material, it may also 'squash' or deform to accommodate the unit dose article in the container.

The periphery of the unit dose article may exclude the flange. If the periphery of the unit dose article excludes the flange, the ratio of the first largest cross-sectional dimension to the second largest cross-sectional dimension is preferably from 0.99:1 to 0.99:1.8 and the first smallest cross-sectional dimension to the second smallest cross-sectional dimension of the internal compartment is from 0.99:1 to 0.99:1.8.

The flange may squash, the unit dose article per se may squash or both may squash.

The unit dose articles are positioned side-by-side to form a single row of unit dose articles within the container. Without wishing to be bound by theory, by placing in a single row, there is reduced contact between neighbouring unit dose articles. This reduces the risk of contamination of multiple neighbours by e.g. water from the hands of consumer retrieving a unit dose article or from contamination of leaking unit dose articles. Also, since they are arranging in a single row, there is reduced risk of neighbouring unit dose article 'clumping' together and causing blockage of the opening. Without wishing to be bound by theory, if the unit dose articles are arranged in a row the contact point between adjacent unit dose articles is well defined. Clumping can be reduced by engineering a mechanical feature in the container that re-separates them, for example, a sliding or gripping means can pull the unit dose articles apart again.

The single row arrangement also has the added benefit of maximising space during storage of the packaged product. Traditional tubs and bags tend to have a large footprint which is inconvenient to the consumer during storage of the product. By ensuring the unit dose articles are arranged in a single row, the footprint of the container is reduced.

Figure 9A:
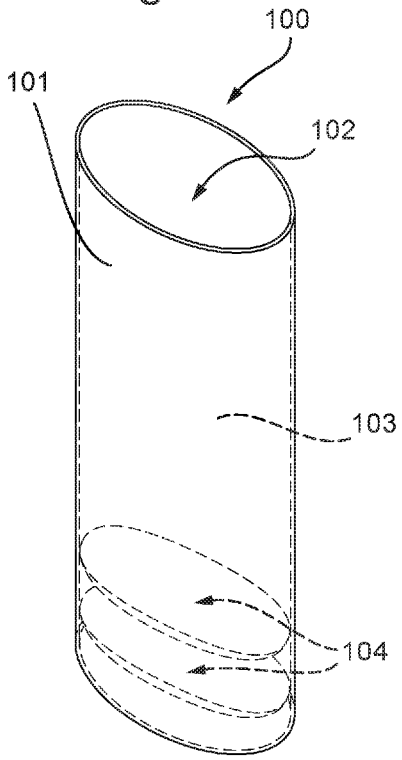
FIGS. 9A, B and C disclose a packaged product according to the present invention.
Figure 9B:
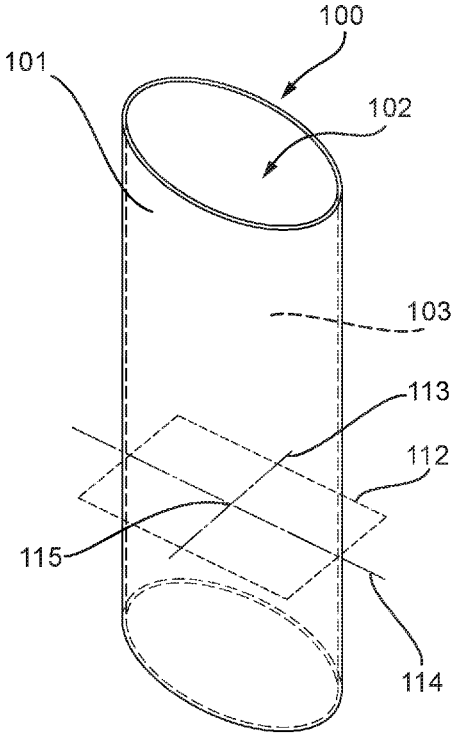
Figure 9C:
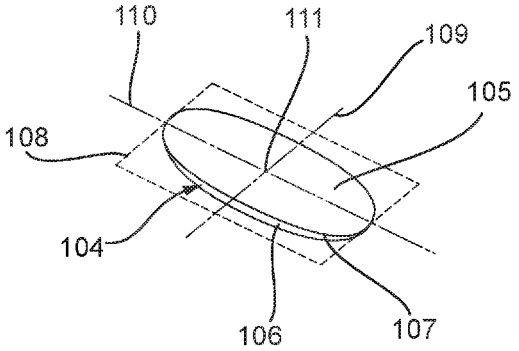

As can be seen in FIG. 9, the packaged product 100 comprises a container 101 wherein the container 101 comprises an opening 102 and an internal compartment 103, and at least two flexible water-soluble unit dose articles 104 held within the internal compartment 103 of the container 101. The unit dose article 104 comprises at least a first film 105 and second film 106 wherein the first film 105 and second film 106 are sealed together forming a seal area 107 wherein said seal area 107 runs around the periphery of the pouch defining a first two dimensional cross-sectional plane 108. The unit dose article 104 comprises a first smallest cross-sectional axis 109 and a first largest cross sectional axis 110 wherein the first smallest 109 and first largest cross-sectional axis 110 cross one another through a geometrical centre point 111 of the first two dimensional cross-sectional plane 108. The internal compartment 103 of the container 101 comprises a second two-dimensional cross-sectional plane 112 parallel to the first two-dimensional cross-sectional plane 108. The internal compartment 103 comprises a second smallest cross-sectional axis 113 and a second largest cross sectional axis 114 wherein the second smallest 113 and second largest cross-sectional axis 114 cross one another through a geometrical centre point 115 of the second two dimensional cross-sectional plane 112. The ratio of the first largest cross-sectional dimension 110 to the second largest cross-sectional dimension 114 is from 1.2:1 to 1:1.8, preferably from 1:1.1 to 1:1.6, more preferably from 1:1.2 to 1:1.5 and the first smallest cross-sectional dimension 109 to the second smallest cross-sectional dimension 113 of the internal compartment 103 is from 1.2:1 to 1:1.8, preferably from 1:1.1 to 1:1.6, more preferably from 1:1.2 to 1:1.5.

Without wishing to be bound by theory, by reducing the amount of available space between neighbouring unit dose articles and between unit dose articles and the walls of the internal compartment, the amount of free space available for moisture ingress is reduced so reducing the overall problem of moisture contamination of the unit dose articles. In addition, this has the added benefit of minimising wasted space and wasted package material providing environmental and cost savings.

The container may comprise at maximum 25 unit dose articles. Without wishing to be bound by theory, if too many unit dose articles are present, then there may be undue pressure exerted on some unit dose articles by the surrounding articles which may result in unwanted rupture of unit dose articles.

The container may comprise a means to effect release of the unit dose article from the container upon actuation of the means by the consumer. The means may effect transfer of the unit dose article from the internal compartment through the opening and into the external environment. Alternatively, the means may effect transfer of the unit dose article from the internal compartment to a position prior to the opening. Alternatively, the means effect the transfer of the unit dose article from a position prior to the opening but not in the internal compartment, through the opening and to a position external of the container.

Those skilled in the art would recognise suitable means, for example mechanical, electronic or a mixture thereof, preferably mechanical means. Those skilled in the art would recognise suitable mechanical means. The mechanical means may be selected from spring mechanisms, twist mechanisms, push or pull mechanisms, turn mechanisms, gear wheels and mixtures thereof. The mechanical means may be a manually operated mechanical means.

Those skilled in the art would recognise suitable manual means. One suitable manual means is in the form of a flexible zone within the walls of the container. Upon application of pressure to the flexible zone, the volume of the internal compartment is reduced forcing a unit dose article to be pushed out of the internal compartment and through the opening.

The container may comprise a means to allow it to be temporarily secured to a surface. For example it may comprise a releasable pressure means such as a 'vacuum suction cup', an adhesive, a hanging element or a mixture thereof. Without wishing to be bound by theory such a means would hinder children in obtaining the container. Also, it would help secure the container to a position for later easy retrieval.

The container may comprise at least two compartments wherein each compartment comprises at least two unit dose articles and wherein each compartment is physically separated from the next. The unit dose articles in the at least two separate compartments may be the same or different, i.e. they could differ in composition or even shape.

Flexible Water-Soluble Unit Dose Article

A water-soluble unit dose article is generally in the form of a pouch. It comprises a unitary dose of a composition as a volume sufficient to provide a benefit in an end application.

The water-soluble unit dose article comprises at least one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments, or even at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the cleaning composition may be comprised in at least one of the compartments. It may for example be comprised in just one compartment, or may be comprised in two compartments, or even in three compartments.

The cleaning composition may be a laundry detergent composition, an automatic dishwashing composition, a hard surface cleaning composition or a combination thereof. The cleaning composition may comprise a solid, a liquid or a mixture thereof. The term liquid includes a gel, a solution, a dispersion, a paste or a mixture thereof.

The unit dose article may comprise a flange. Said flange is comprised of excess sealed film material that protrudes beyond the edge of the unit dose article and provides increased surface area for seal of the first and second films.

The unit dose article has a height, a width and a length. The maximum of any of these dimensions is meant to mean the greatest distance between two points on opposite sides of the unit dose article. In other words, the unit dose article may not have straight sides and so may have variable lengths, widths and heights depending on where the measurement is taken. Therefore, the maximum should be measured at any two points that are the furthest apart from each other.

The maximum length may be between 2 cm and 5 cm, or even between 2 cm and 4 cm, or even between 2 cm and 3 cm. The maximum length maybe greater than 2 cm and less than 6 cm The maximum width may be between 2 cm and 5 cm. The maximum width maybe greater than 3 cm and less than 6 cm.

The maximum height may be between 2 cm and 5 cm. The maximum height maybe greater than 2 cm and less than 4 cm.

These lengths may be in the presence or absence of the flange.

Preferably, the length:height ratio is from 3:1 to 1:1; or the width:height ratio is from 3:1 to 1:1, or even 2.5:1 to 1:1; or the ratio of length to height is from 3:1 to 1:1 and the ratio of width to height is from 3:1 to 1:1, or even 2.5:1 to 1:1, or a combination thereof. These ratios may be in the presence of absence of a flange.

Each individual unit dose article may have a weight of between 10 g and 40 g, or even between 15 g and 35 g.

One or more sides of the unit dose article may have a radius of curvature. In other words, the unit dose article preferably does not comprise substantially straight sides or right angled corners. Without wishing to be bound by theory, this is preferred as it reduces the available surface area of unit dose articles to contact one another and the walls of the container. Preferably the contacting sides between the side by side positioned unit dose articles have a radius of curvature.

The film of the present invention is soluble or dispersible in water. Prior to be being formed into a unit dose article, the water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

50 grams±0.1 gram of film material is added in a preweighed 400 ml beaker and 245 ml±1 ml of distilled water is added. This is stirred vigorously on a magnetic stirrer, Labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The unit dose article may be flowed wrapped. Flow wrapped unit dose articles comprise an outer water insoluble film. The flow wrapped unit dose articles maybe joined together by the external flow wrap film and wherein the flow wrap film comprises an area of weakness between adjacent unit dose articles to allow them to be separated. An example of an area of weakness is a perforated line.

Method of Use

The present invention also considers a method of delivering a flexible water-soluble unit dose article to the drum or drawer of a fabric washing machine or to an automatic ware washing machine, comprising the steps of;

a. Obtaining a unit dose article in a container according to the present invention;
b. Positioning the container near the drawer, drum or other reception point;
c. Ejecting the unit dose article from the container directly in the drum, drawer or other reception point;
d. Removing the container from the position near the drawer, drum or other reception point;
e. Initiating the wash operation of the fabric washing machine or automatic ware washing machine.

Alternatively, in step c, the unit dose article may be ejected into the hand of the consumer and then placed by the consumer into the drawer, drum or other reception point.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

EXAMPLES

FIG. 1 discloses a packaged product (1) comprising a container (2) wherein the container comprises an opening (3) and an internal compartment (4), and at least two flexible water-soluble unit dose articles (5 and 6) held within the internal compartment (4) of the container (2). The unit dose articles (5 and 6) are positioned side-by-side to form a single row of unit dose articles within the container (2). The smallest cross sectional area of the internal compartment (10) is shown.

Figure 2A:
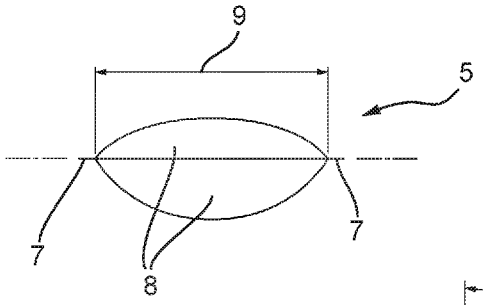
FIGS. 2A, 2B, 2C and 2D disclose unit dose articles according to the present invention.

The unit dose articles (5 and 6) comprise flanges (7) and a radius of curvature (8), FIG. 2A disclose a side profile of a unit dose article (5) comprising a radius of curvature (8), and flanges (7). It also discloses the longest cross sectional dimension of the unit dose article (9).

Figure 2B:
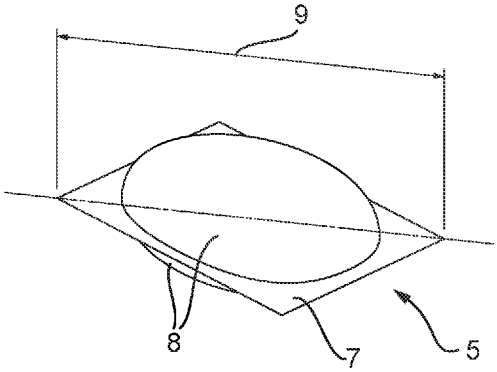

FIG. 2B discloses a three dimensional representation of a unit dose article (5) highlighting the longest cross sectional dimension (9).

Figure 2C:
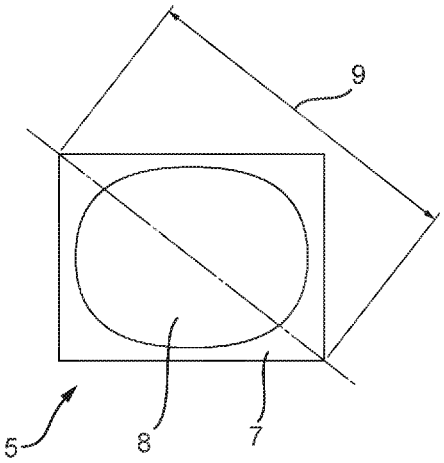
Figure 2D:
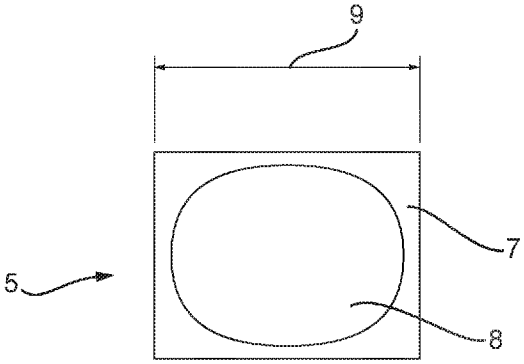

FIGS. 2C and 2D disclose top profile representation of unit dose articles (5) highlighting the longest cross sectional dimension (9).

Figure 3:
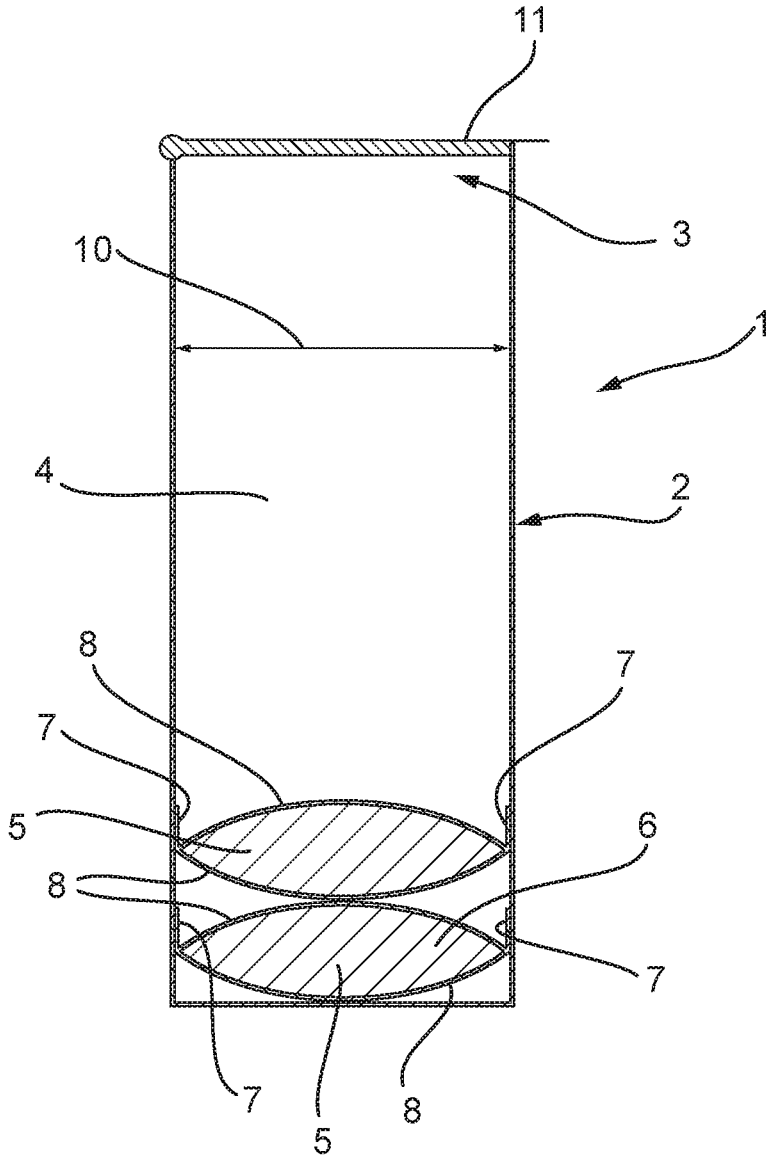
FIG. 3. discloses a packaged product according to the present invention comprising a recloseable means.

FIG. 3 discloses a packaged product (1) comprising a container (2) wherein the container comprises an opening (3) and an internal compartment (4), and at least two flexible water-soluble unit dose articles (5 and 6) held within the internal compartment (4) of the container (2). The unit dose articles (5 and 6) are positioned side-by-side to form a single row of unit dose articles within the container (2). The smallest cross sectional area of the internal compartment (10) is shown. The opening (3) comprises a recloseable means (11).

Figure 4:
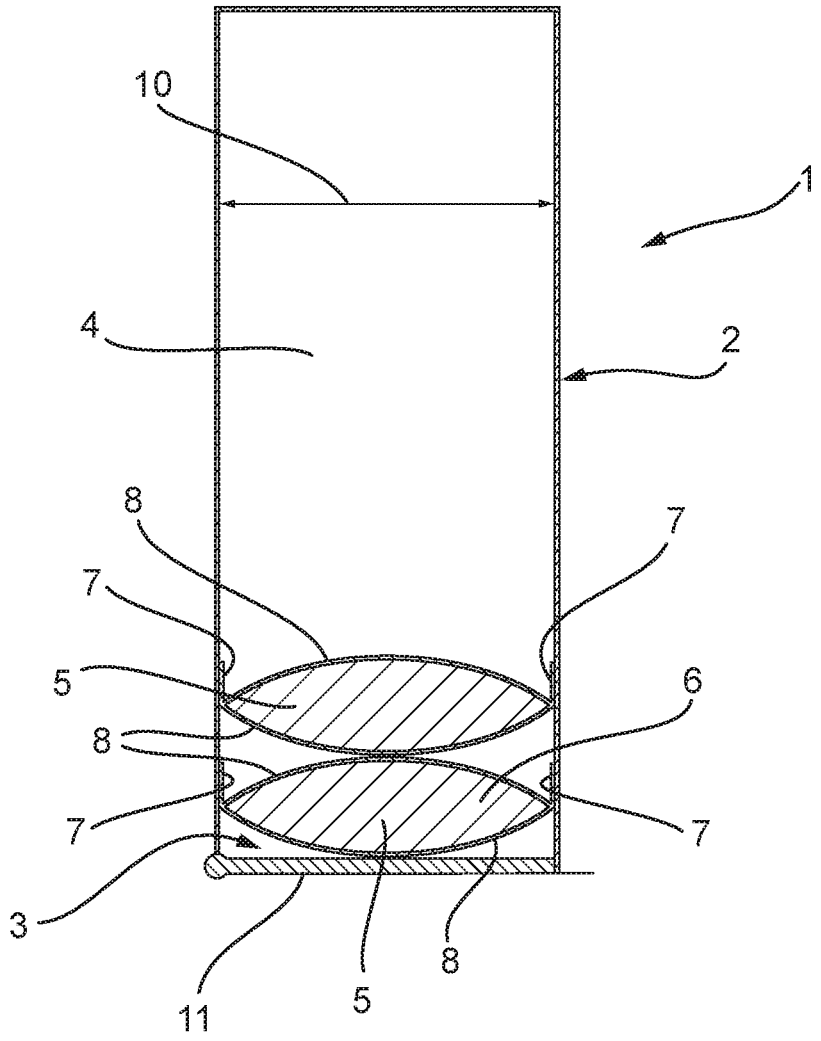
FIG. 4 discloses a packaged product according to the present invention comprising a recloseable means.

FIG. 4 discloses the packaged product (1) of FIG. 3 wherein the recloseable means (11) is positioned at the base of the container (2).

Figure 5:
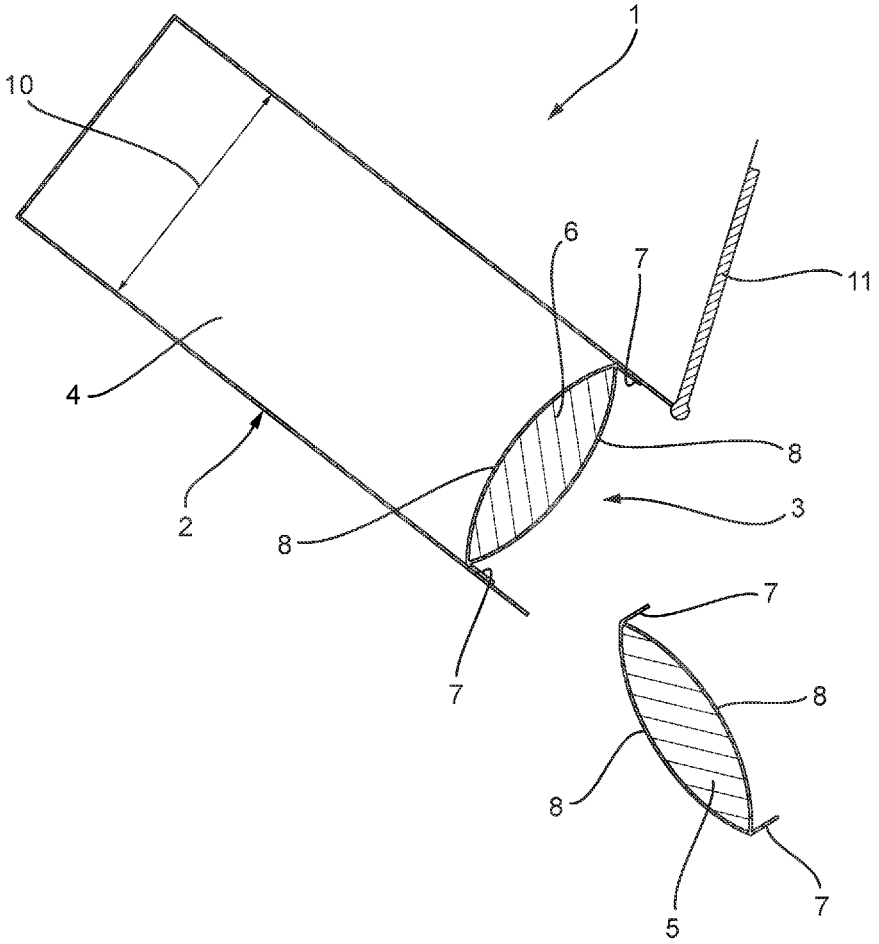
FIG. 5 discloses the packaged product of FIG. 3 wherein a single unit dose article is dispensed from the container.

FIG. 5 discloses the packaged product (1) of FIG. 3 wherein the recloseable means (11) is open, and the container (2) has been tilted such that a single unit dose article (5) is ejected from the container (2) through the opening (3).

Figure 6B:
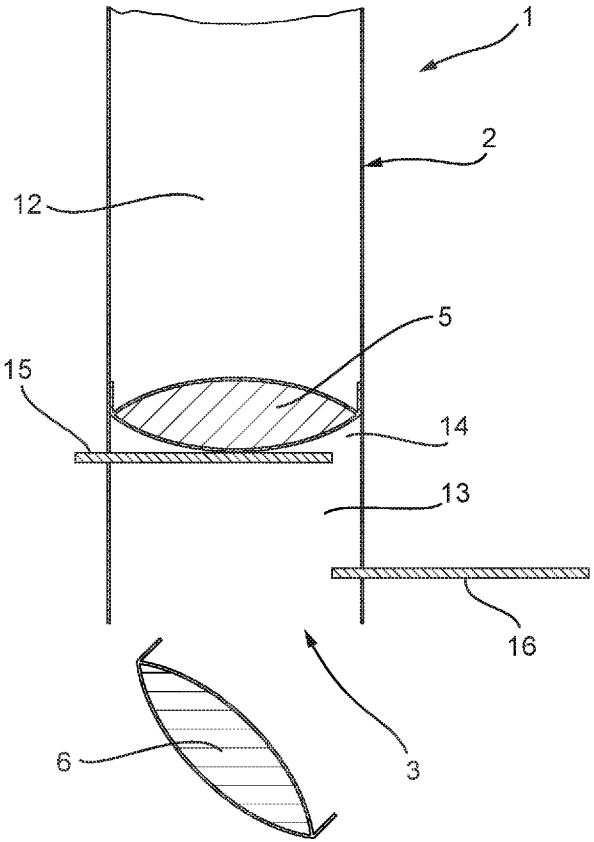
FIGS. 6A and B disclose a packaged product according to the present invention comprising two reclosing means.
Figure 6A:
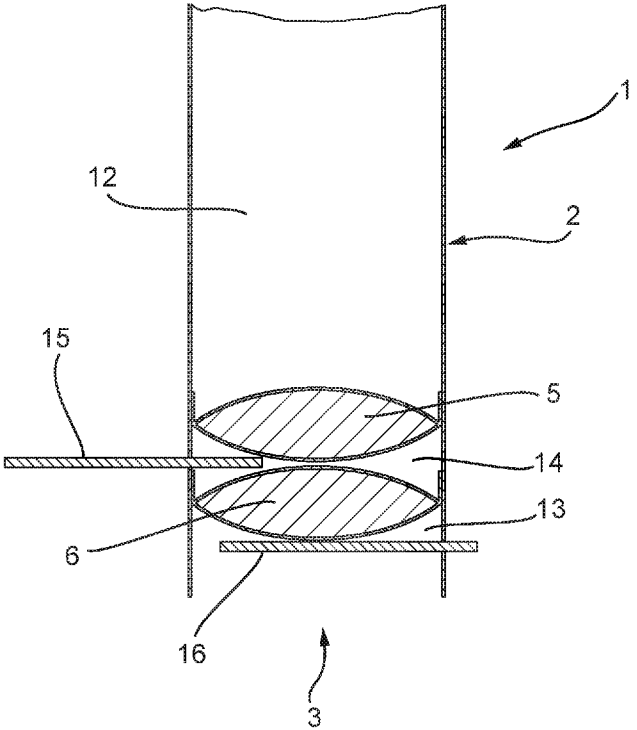

FIG. 6 discloses a packaged product according to the present invention. FIG. 6A discloses a packaged product (1) comprising a container (2), wherein the container (2) comprises a first compartment (12), a second compartment (13) and an external opening (3). The container (2) comprises at least two flexible water-soluble unit dose articles (5 and 6), wherein the first compartment (12) and the second compartment (13) are connected via an internal opening (14), wherein the internal opening (14) comprises a first removable blocking means (15) between the first (12) and second compartments (13). A second removable blocking means (16) is located between the second compartment (13) and the external opening (3).

The first blocking means (15) is sufficient to prevent a water-soluble unit dose article (5) from passing through the internal opening (14) and the second blocking means (16) is sufficient to prevent a water-soluble unit dose article (6) from passing through the external opening (3).

FIG. 6A discloses the packaged product (1) wherein the first recloseable blocking means (15) is open and the second recloseable blocking means in closed (16). In FIG. 2A, the first recloseable blocking means (15) is closed and the second recloseable blocking means (16) is open allowing the unit dose article (6) to pass through the external opening (3) however the second unit dose article (5) remains within the first compartment (12). This allows only one unit dose article (6) to exit the container (2) at a time.

Figure 7B:
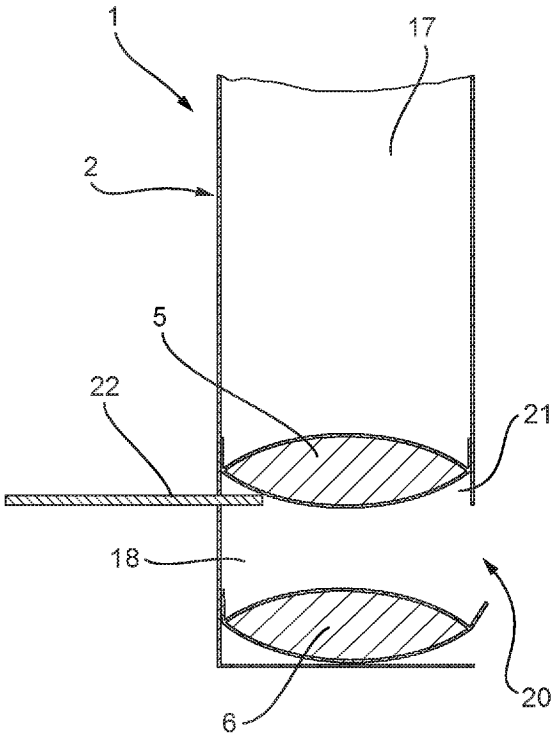
FIGS. 7A, B, C and D disclose a packaged product according to the present invention comprising a recloseable means and its operation.
Figure 7A:
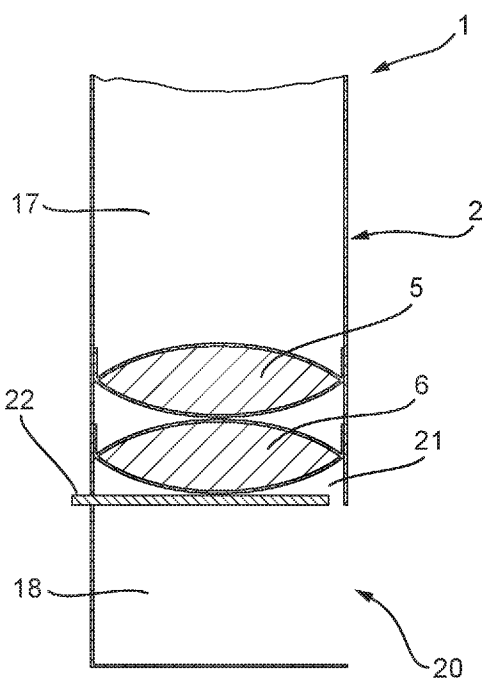

FIG. 7A discloses a packaged product (1) comprising a container (2), wherein the container (2) comprises a first compartment (17), a second compartment (18) and an external opening (20), wherein the container (2) comprises at least two flexible water-soluble unit dose articles (5 and 6), wherein the first compartment (17) and the second compartment (18) are connected via an internal opening (21), wherein the internal opening (21) comprises a removable blocking means (22) between the first (17) and second compartments (18), wherein the blocking means (22) is sufficient to prevent a water-soluble unit dose article (5) from passing through the internal opening (21) and wherein the external opening (20) connects to the second compartment (18) and is located at an angle of between 75° and 105° relative to the second compartment (18). The removeable blocking means (22) is in the closed position.

FIG. 7B shows the packaged product (1) of FIG. 7A wherein the removable blocking means (22) is open. As such the water-soluble unit dose article (6) has moved from the first compartment (17) through the internal opening (21) and into the second compartment (18).

Figure 7D:
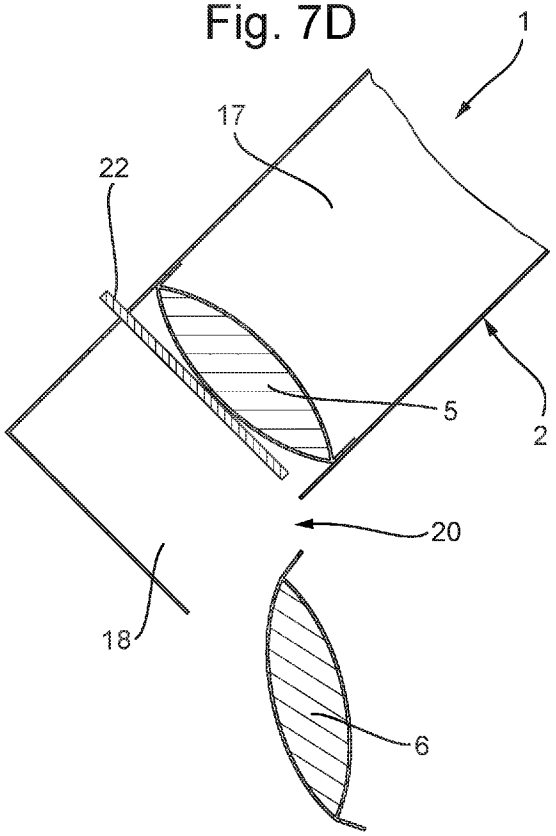
Figure 7C:
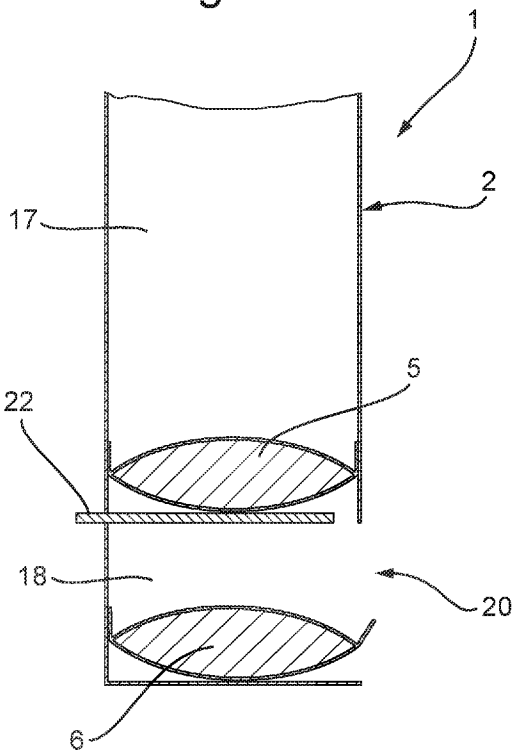

FIG. 7C shows the packaged product (1) of FIGS. 7A and 7B, wherein the removable blocking means (22) has been returned to the closed position so preventing the water-soluble unit dose article (5) from passing from the first compartment (17) to the second compartment (18).

FIG. 7D shows the packaged product (1) of FIGS. 7A, 7B and 7C, wherein the container (2) has been tilted so that the unit dose article (7) can exit through the external opening (5), however the second unit dose article (6) remains in the first compartment (3).

Figure 8B:
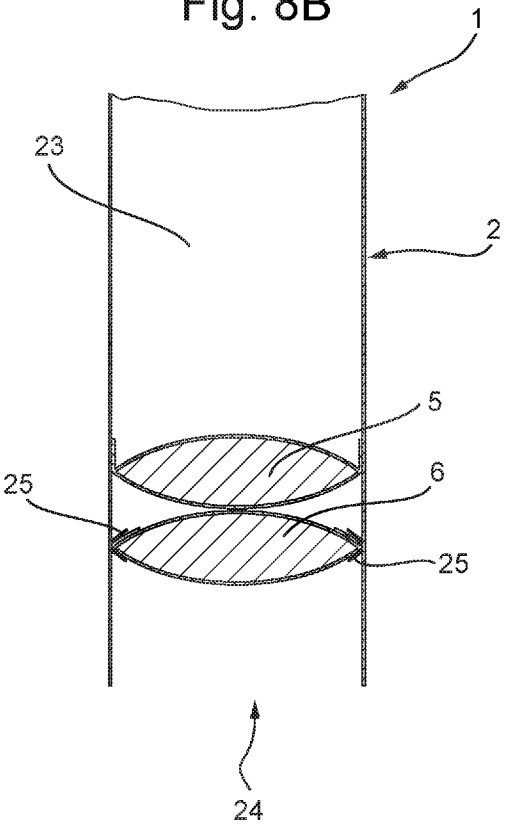
FIGS. 8A, B and C disclose a packaged product according to the present invention comprising a gripping means and its operation.
Figure 8A:
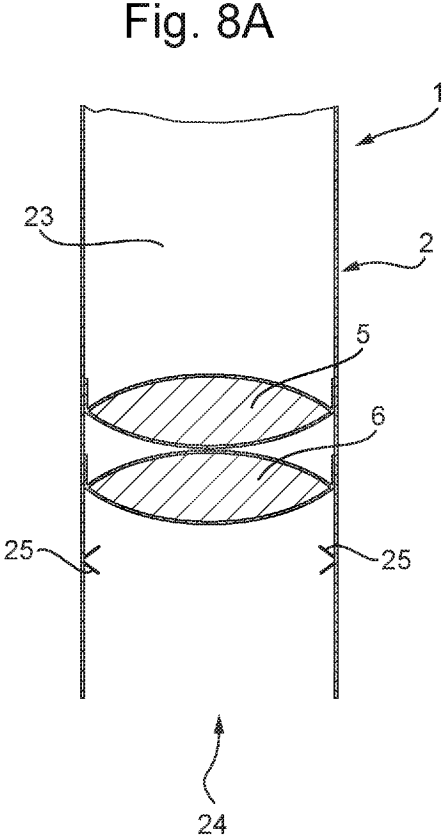

FIG. 8A discloses a packaged product (1) comprising a container (2), wherein the container (2) comprises an internal compartment (23) and an opening (24) and at least two flexible water-soluble unit dose articles (5 and 6) held within the internal compartment (23), wherein the unit dose articles (5 and 6) are positioned side-by-side to form a single row of unit dose articles within the container, and wherein the container (2) comprises a gripping means (25) located between the internal compartment (23) and the opening (24) and wherein the gripping means is suitable to grip one unit dose article at a time and move it from the internal compartment (23) to the opening (24) when the gripping means (25) is activated by a user.

FIG. 8B discloses the packaged product (1) of FIG. 8A wherein the gripping means (25) has gripped a single unit dose article (6).

Figure 8C:
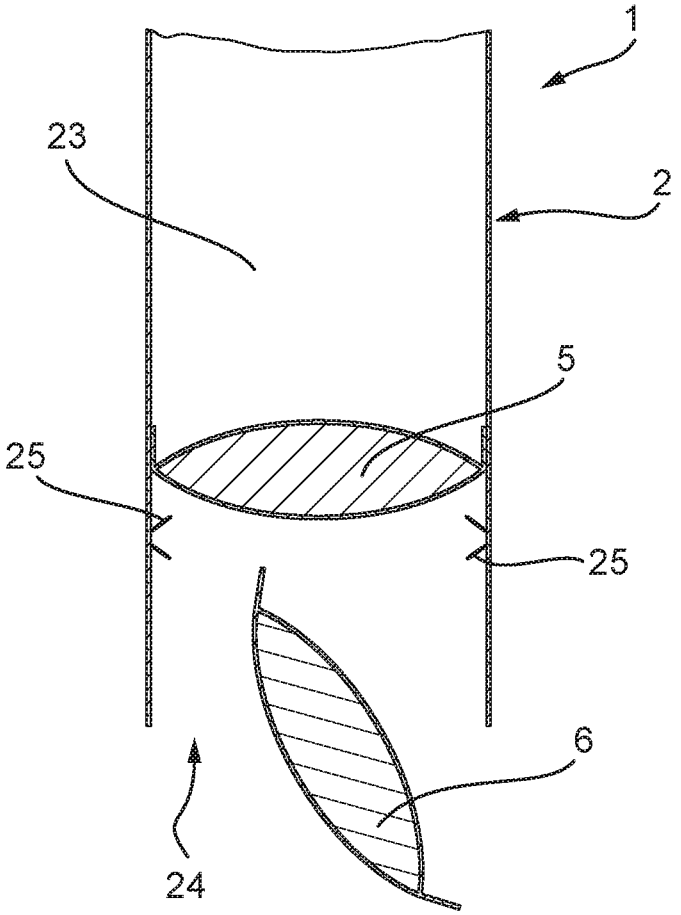

FIG. 8C discloses the packaged product (1) of FIGS. 8A and 8B wherein the gripping means (25) has released the single unit dose article (6) which has exited the container through the opening (4).

Example 1

A packaged product in accordance with FIG. 6 was compared to a standard off-the-shelf rigid plastic container (Ariel Pods product).

The packaged product according to the invention (Package A) comprised a tube shaped container filled with unit dose articles (stacked on top of each other) and a dispenser means. The open tube comprises a plate inside the dispenser acting as a blocking means, preventing the unit dose articles from falling out of the container. A rotating action moves the tube and will release 1 unit dose article at a time, preventing the unit dose article above to be released as well by means of an internal wall. The rotation action is controlled by means of a rubber band to bring it back into its original position after actuation.

Off Position:

Unit dose articles are stacked one on top of each other in the container and are held in place by the bottom plate of the container. Rubber band is connecting the tube (moving part) with the fixed bottom plate of the dispenser is in rest On Position:

By actuation (push lever rotational action) following actions are triggered:

Opening of the moving tube is positioned above the opening of the blocking means of the container allowing movement of a single unit dose article. Remaining of the stack of unit dose articles is stopped by a second blocking means connected to side wall of fixed part of container, sliding into a rectangular slot in the moving tube. Rubber band is extended. When lever is released, the rubber band relaxes and returns the moving tube to 'off' position, so that the opening of the tube is again located above the blocking means of the container.

The off-the-shelf rigid product comprised a tub with a lid (Package C). The unit dose articles were arranged randomly within the tub, and the consumer had to first open the hinged lid, followed by retrieving a unit dose article using their hand, followed by closing the lid.

25 consumers were each asked to dose a single unit dose article from the package C). They were asked to dose a single unit dose article from package A and a single unit dose article from package C into a receptacle, and replace the package to its starting point. In each case the receptacle was placed in front of the unit dose article at a distance of 36 cm (edge of the receptacle to edge of the package). In was noted how many times a unit dose article was dispensed into the receptacle using package A wherein the consumer dosed a single unit dose article at a time without touching. Also, the time taken for the consumer to complete the dosing operation and replace the package to the starting position was recorded.

Results can be seen in Table 1;

| | Package A | Package C |
|---|---|---|
| Time (s) to dose 1 unit dose article into receptacle | 3.4 +/− 0.4 | 5.4 +/− 0.7 |
| Instances of one unit dose article dosed without touch | 25/25 | |

As can be seen from Table 1, a single unit dose article was dosed from package A in all 25 attempts. The time taken to complete the dosing operation with package A was less than with package C.

Example 2

A packaged product in accordance with FIG. 8 was compared to a standard off-the-shelf rigid plastic container (Ariel Pods product).

The packaged product according to the invention (Package B) comprised a gripping means. The package consists of a long tube-shaped part where the unit dose articles are stored (on top of each other). Pushing the top of this tube downwards will activate a mechanism with cantilever claws at the bottom of the package. The downwards pushing action forces the claws to open so 1 unit dose article can be released whilst in this same continuous movement the unit dose article above is kept in place due to the specific shape of the claws. When the tube is released, rubber bands will force the tube back to its original position (before actuation).

Off Position:

Unit dose articles in the tube are hold by 2 clamps

On Position:

By actuation (vertical push of button on top of package), the side walls of the rigid tube pushes on the lever mechanism so that the claws are opening, releasing 1 unit dose article. Due to as special shape of the claws, they release 1 unit dose article while blocking/holding the remaining of the stack of unit dose articles above.

The off-the-shelf rigid product comprised a tub with a lid (Package C). The unit dose articles were arranged randomly within the tub, and the consumer had to first open the hinged lid, followed by retrieving a unit dose article using their hand, followed by closing the lid.

25 consumers were each asked to dose a single unit dose article from the packaged product according to the invention (package B) and the rigid plastic container (package C). They were asked to dose a single unit dose article from package A and a single unit dose article from package B into a receptacle, and replace the package to its starting point. In each case the receptacle was placed in front of the unit dose article at a distance of 36 cm (edge of the receptacle to edge of the package). In was noted how many times a unit dose article was dispensed into the receptacle using package B wherein the consumer dosed a single unit dose article at a time without touching. Also, the time taken for the consumer to complete the dosing operation and replace the package to the starting position was recorded.

Results can be seen in Table 2;

| | Package B | Package C |
|---|---|---|
| Time (s) to dose 1 unit dose article into receptacle | 3.3 +/− 0.6 | 5.4 +/− 0.7 |
| Instances of one unit dose article dosed without touch | 24/25 | |

As can be seen from Table 2, a single unit dose article was dosed from package B in 24 out of 25 attempts. The time taken to complete the dosing operation with package B was less than with package C.

"The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. A packaged product comprising a container wherein the container comprises an opening and an internal compartment, and at least two flexible water-soluble unit dose articles held within the internal compartment of the container, wherein the unit dose articles are positioned side-by-side to form a single row of unit dose articles within the container, wherein the unit dose article comprises at least a first film and second film wherein the first film and second film are sealed together forming a seal area wherein said seal area runs around the periphery of the pouch defining a first two dimensional cross-sectional plane; and wherein the pouch comprises a first smallest cross-sectional axis and a first largest cross sectional axis wherein the first smallest and first largest cross-sectional axis cross one another through a geometrical centre point of the first two dimensional cross-sectional plane; and wherein the internal compartment of the container comprises a second two-dimensional cross-sectional plane parallel to the first two-dimensional cross-sectional plane; and wherein the internal compartment comprises a second smallest cross-sectional axis and a second largest cross sectional axis wherein the second smallest and second largest cross-sectional axis cross one another through a geometrical centre point of the second two dimensional cross-sectional plane;

and wherein the ratio of the first largest cross-sectional dimension to the second largest cross-sectional dimension is from about 1.2:1 to about 1:1.8 and the first smallest cross-sectional dimension to the second smallest cross-sectional dimension of the internal compartment is from about 1.2:1 to about 1:1.8.

2. The packaged product according to claim 1, wherein the unit dose articles comprise a flange.

3. The packaged product according to claim 1, wherein the package comprises at most 25 pouches.

4. The packaged product according to claim 1, wherein the container has a straight or curved shape.

5. The packaged product according to claim 1, wherein the internal compartment of the container has a circular, square, rectangular, triangular or oval shape.

6. The packaged product according to claim 1, wherein the container and/or recloseable means are opaque, transparent or translucent.

7. The packaged product according to claim 1 wherein one or more sides of the unit dose article, have a radius of curvature.

8. The container according to claim 1 wherein the recloseable opening is arranged so that the unit dose article exits the package vertically or horizontally.

9. The container according to 1, wherein the unit dose article comprises at least two compartments.

10. The container according to claim 1, wherein the container comprises at least two compartments, wherein each compartment comprises at least two unit dose articles and wherein each compartment is physically separated from the next.

11. The packaged product according to claim 1, wherein the opening comprises a recloseable means.

12. The packaged product according to claim 11, wherein recloseable means is a child deterrent closure.

13. The packaged product according to claim 1, wherein the ratio of the first largest cross-sectional dimension to the second largest cross-sectional dimension is from about 1:1.1 to about 1:1.6, and the first smallest cross-sectional dimension to the second smallest cross-sectional dimension of the internal compartment is from about 1:1.1 to about 1:1.6.

14. The packaged product according to claim 13 wherein the ratio of the first largest cross-sectional dimension to the second largest cross-sectional dimension is from about 1:1.2 to about 1:1.5.

15. The packaged product according to claim 13, wherein the ratio of the first smallest cross-sectional dimension to the second smallest cross-sectional dimension of the internal compartment is from about 1:1.2 to about 1:1.5.

16. The container according to claim 1, wherein the unit dose article comprises a water-soluble film defining at least one internal compartment and a cleaning composition contained within said compartment.

17. The container according to claim 16 wherein the cleaning composition comprises a liquid.

18. The container according to claim 17 wherein the composition is a laundry detergent composition, an automatic dishwashing composition, a hard surface cleaning composition or a combination thereof.

19. The container according to claim 1, wherein the container comprises mechanical means, or electronic means to allow the release of one unit dose article at a time from the container upon activation of the actuation means by the user.

20. The container according to claim 19, wherein the actuation means is a mechanical means.

21. The container according to claim 20, wherein the actuation is manual mechanical means.

22. A method of delivering a flexible water-soluble unit dose article to the drum or drawer of a fabric washing machine or to an automatic ware washing machine, comprising the steps of;

a. Obtaining a unit dose article in a container according to claim 1;

b. Positioning the container near the drawer, drum or other reception point;

c. Ejecting the unit dose article from the container directly in the drum, drawer or other reception point;

d. Removing the container from the position near the drawer, drum or other reception point;

e. Initiating the wash operation of the fabric washing machine or automatic ware washing machine.

23. The method according to claim 22 wherein, in step c, the unit dose article is ejected into the hand of a consumer and then placed by the consumer into the drawer, drum or other reception point.

* * * * *